US009850885B2

(12) United States Patent
Sakamoto

(10) Patent No.: US 9,850,885 B2
(45) Date of Patent: Dec. 26, 2017

(54) ENGINE OVERLOAD PREVENTION USING A SPEED DIFFERENTIAL OPERATED RELIEF VALVE

(71) Applicant: YANMAR CO., LTD., Osaka (JP)

(72) Inventor: Kunihiko Sakamoto, Fukuoka (JP)

(73) Assignee: YANMAR CO., LTD., Osaka (JP)

( * ) Notice: Subject to any disclaimer, the term of this patent is extended or adjusted under 35 U.S.C. 154(b) by 616 days.

(21) Appl. No.: 14/364,177

(22) PCT Filed: Dec. 12, 2012

(86) PCT No.: PCT/JP2012/082168

§ 371 (c)(1),
(2) Date: Jun. 10, 2014

(87) PCT Pub. No.: WO2013/089127

PCT Pub. Date: Jun. 20, 2013

(65) Prior Publication Data

US 2014/0322045 A1 Oct. 30, 2014

(30) Foreign Application Priority Data

Dec. 13, 2011 (JP) ..... 2011-272570
Dec. 13, 2011 (JP) ..... 2011-272571

(51) Int. Cl.
*F04B 1/32* (2006.01)
*F04B 17/05* (2006.01)
(Continued)

(52) U.S. Cl.
CPC ..... *F04B 1/324* (2013.01); *E02F 9/2079* (2013.01); *E02F 9/226* (2013.01); *E02F 9/2235* (2013.01);
(Continued)

(58) Field of Classification Search
CPC .. F04B 1/295; F04B 1/324; F04B 1/34; F04B 17/05; F04B 2203/0209; F04B 2207/01;
(Continued)

(56) References Cited

U.S. PATENT DOCUMENTS 3,962,870 A * 6/1976 Lech ..... E02F 9/2239 60/428
4,274,257 A * 6/1981 Koch, Jr. ..... F16H 61/465 417/222.1
(Continued)

FOREIGN PATENT DOCUMENTS

JP H0231919 A 2/1990
JP 492031 A 3/1992
(Continued)

OTHER PUBLICATIONS

Japanese Notice of Reasons for Refusal corresponding to Patent Application No. 2011-272571; Shipping Date: Jun. 9, 2015, with English translation.
(Continued)

*Primary Examiner* — Bryan Lettman
*Assistant Examiner* — Timothy Solak
(74) *Attorney, Agent, or Firm* — Cantor Colburn LLP

(57) ABSTRACT

A working vehicle provided with a fixed-capacity hydraulic pump driven by power from an engine and a working hydraulic actuator driven by working oil pumped from the fixed-capacity hydraulic pump is a rotary working vehicle which is provided with an electromagnetic relief valve for modifying the pressure of working oil from the fixed-capacity hydraulic pump, and the rotary working vehicle is such that if the actual number of revolutions (N) of the engine is reduced by a set number of revolutions (Ns) as the load on the engine increases, then the electromagnetic relief valve operates in accordance with the deviation (e) between
(Continued)

the actual number of revolutions (N) of the engine and the specified number of revolutions (Ns), and the pressure of the working oil from the fixed-capacity hydraulic pump is modified.

2 Claims, 13 Drawing Sheets

(51) Int. Cl.

| | |
|---|---|
| ***F04B 49/08*** | (2006.01) |
| ***F04B 49/06*** | (2006.01) |
| ***F15B 20/00*** | (2006.01) |
| ***F15B 11/042*** | (2006.01) |
| ***E02F 9/20*** | (2006.01) |
| ***E02F 9/22*** | (2006.01) |
| ***F04B 49/20*** | (2006.01) |
| ***F04B 1/29*** | (2006.01) |

(52) U.S. Cl.
CPC ..... *E02F 9/2246* (2013.01); *E02F 9/2282* (2013.01); *E02F 9/2285* (2013.01); *E02F 9/2292* (2013.01); *E02F 9/2296* (2013.01); *F04B 1/29* (2013.01); *F04B 1/32* (2013.01); *F04B 17/05* (2013.01); *F04B 49/065* (2013.01); *F04B 49/08* (2013.01); *F04B 49/20* (2013.01); *F15B 11/0423* (2013.01); *F04B 2203/0209* (2013.01); *F15B 20/007* (2013.01); *F15B 2211/20523* (2013.01); *F15B 2211/20538* (2013.01); *F15B 2211/20546* (2013.01); *F15B 2211/20576* (2013.01); *F15B 2211/30595* (2013.01); *F15B 2211/50518* (2013.01); *F15B 2211/50536* (2013.01); *F15B 2211/5157* (2013.01); *F15B 2211/526* (2013.01); *F15B 2211/55* (2013.01); *F15B 2211/633* (2013.01); *F15B 2211/6346* (2013.01); *F15B 2211/6652* (2013.01); *F15B 2211/86* (2013.01)

(58) Field of Classification Search
CPC ..... F04B 23/08; F04B 41/06; F04B 49/103; F04B 49/22; E02F 9/2246
See application file for complete search history.

(56) References Cited

U.S. PATENT DOCUMENTS

| | | | | |
|---|---|---|---|---|
| 5,186,612 | A * | 2/1993 | Budzich | F04B 49/08 417/216 |
| 5,295,353 | A | 3/1994 | Ikari | |
| 6,010,309 | A | 1/2000 | Takamura et al. | |
| 2004/0157701 | A1 | 8/2004 | Legner | |
| 2004/0208754 | A1 | 10/2004 | McFadden | |
| 2006/0061106 | A1 * | 3/2006 | Asakage | B60H 1/00378 290/40 C |
| 2009/0272109 | A1 * | 11/2009 | Pfaff | E02F 9/2203 60/368 |
| 2010/0236233 | A1 | 9/2010 | Sumiyoshi et al. | |

FOREIGN PATENT DOCUMENTS

| | | | |
|---|---|---|---|
| JP | H07158605 | A | 6/1995 |
| JP | H08253022 | A | 10/1996 |
| JP | 2000319942 | A | 11/2000 |
| JP | 3150284 | B2 | 3/2001 |
| JP | 2011196066 | A | 10/2011 |

OTHER PUBLICATIONS

EESR issued in respect of the corresponding European Application No. 12856890.4-1712/2792797, PCT/JP2012/082168, dated Sep. 1, 2015.

International Search Report corresponding to Application No. PCT/JP2012/082168; dated Apr. 2, 2013, with English translation.

* cited by examiner

ENGINE OVERLOAD PREVENTION USING A SPEED DIFFERENTIAL OPERATED RELIEF VALVE

This is the U.S. national stage of application No. PCT/JP2012/82168, filed on Dec. 12, 2012. Priority under 35 U.S.C. §119(a) and 35 U.S.C. §365(b) is claimed from Japanese Application No. 2011-272570, filed Dec. 13, 2011, and Japanese Application No. 2011-272571, filed Dec. 13, 2011, the disclosures of which are also incorporated herein by reference.

TECHNICAL FIELD

The present invention relates to a working vehicle which can reduce load of an engine caused by a fixed displacement type hydraulic pump.

BACKGROUND ART

Conventionally, a working vehicle such as an excavating working machine is known in which a working hydraulic actuator is driven by hydraulic oil sent from a fixed displacement type hydraulic pump. For example, the Patent Literature 1 describes an excavating working machine in which a first hydraulic pump, a second hydraulic pump, a third hydraulic pump and a fourth hydraulic pump are provided in series on an output shaft of an engine. According to the excavating working machine, the third hydraulic pump is a fixed displacement type hydraulic pump, and hydraulic oil is sent from the fixed displacement type hydraulic pump to working hydraulic actuators such as a turning motor, an arm cylinder, an offset cylinder, a boom cylinder and a bucket cylinder so as to drive them.

PRIOR ART REFERENCE

Patent Literature

Patent Literature 1: the Japanese Patent Laid Open Gazette 2000-319942

DISCLOSURE OF INVENTION

Problems to be Solved by the Invention

According to the excavating working machine described in the Patent Literature 1, when load on the engine is increased at high-load work with the working hydraulic actuators, engine stall may occur because the load of the engine caused by the fixed displacement type hydraulic pump cannot be reduced.

The present invention is provided in consideration of the above problem, and the purpose of the present invention is to provide a working vehicle which can reduce load of an engine caused by a fixed displacement type hydraulic pump so as to improve effect of preventing engine stall.

Means for Solving the Problems

Preferably, a working vehicle of the present invention having a fixed displacement type hydraulic pump driven by power from an engine and a working hydraulic actuator driven by hydraulic oil sent from the fixed displacement type hydraulic pump, includes a pressure change means changing a pressure of the hydraulic oil from the fixed displacement type hydraulic pump, a control means controlling the pressure change means, and an actual rotation speed detection means detecting an actual rotation speed of the engine. When load of the engine is increased and the actual rotational speed of the engine becomes lower than a set rotation speed, the pressure of the hydraulic oil from the fixed displacement type hydraulic pump is changed with the pressure change means corresponding to a deviation between the actual rotational speed of the engine and the set rotation speed.

The working vehicle of the present invention has a variable displacement type hydraulic pump driven by the power from the engine and driving the working hydraulic actuator by sending hydraulic oil, and a swash plate angle change means changing a swash plate angle of the variable displacement type hydraulic pump. The control means controls the swash plate angle change means so that when the load of the engine is increased and the actual rotational speed of the engine becomes lower than the set rotation speed, the swash plate angle change means is operated corresponding to the deviation between the actual rotational speed of the engine and the set rotation speed so as to change the swash plate angle of the variable displacement type hydraulic pump, and when the swash plate angle becomes a limiting angle, the pressure change means is operated corresponding to the deviation so as to change the pressure of the hydraulic oil from the fixed displacement type hydraulic pump.

The working vehicle of the present invention has an air conditioning device driven by the power from the engine. The pressure change means is operated following on-off operation of the air conditioning device so as to change the pressure of the hydraulic oil from the fixed displacement type hydraulic pump.

The working vehicle of the present invention has an air conditioning device driven by the power from the engine, and a clutch cutting off and connecting power transmission from the engine to the air conditioning device.

wherein the control means controls the clutch cutting off and connection of the clutch so that when the load of the engine is increased and the actual rotational speed of the engine becomes lower than the set rotation speed, the pressure of the hydraulic oil from the fixed displacement type hydraulic pump is changed with the pressure change means corresponding to the deviation between the actual rotational speed of the engine and the set rotation speed, and when the actual rotational speed of the engine becomes lower than the set rotation speed though the pressure of the hydraulic oil from the fixed displacement type hydraulic pump is changed, the clutch is disengaged.

Effect of the Invention

According to the working vehicle of the present invention, the load of the engine caused by the fixed displacement type hydraulic pump can be reduced so as to improve the effect of preventing the engine stall

BRIEF DESCRIPTION OF DRAWINGS

FIG. 13A is a schematic side view partially in section of a pump unit, and FIG. 13B is a schematic plan view partially in section of the pump unit.

DETAILED DESCRIPTION OF THE INVENTION

Firstly, an explanation will be given on an entire configuration of a turning working vehicle 1 referring to FIG. 1. In this embodiment, the turning working vehicle 1 is explained as an embodiment of a working vehicle. However, the working vehicle is not limited thereto and may alternatively be a vehicle with a hydraulic device, such as an agricultural vehicle, a construction vehicle and an industrial vehicle.

Figure 1:
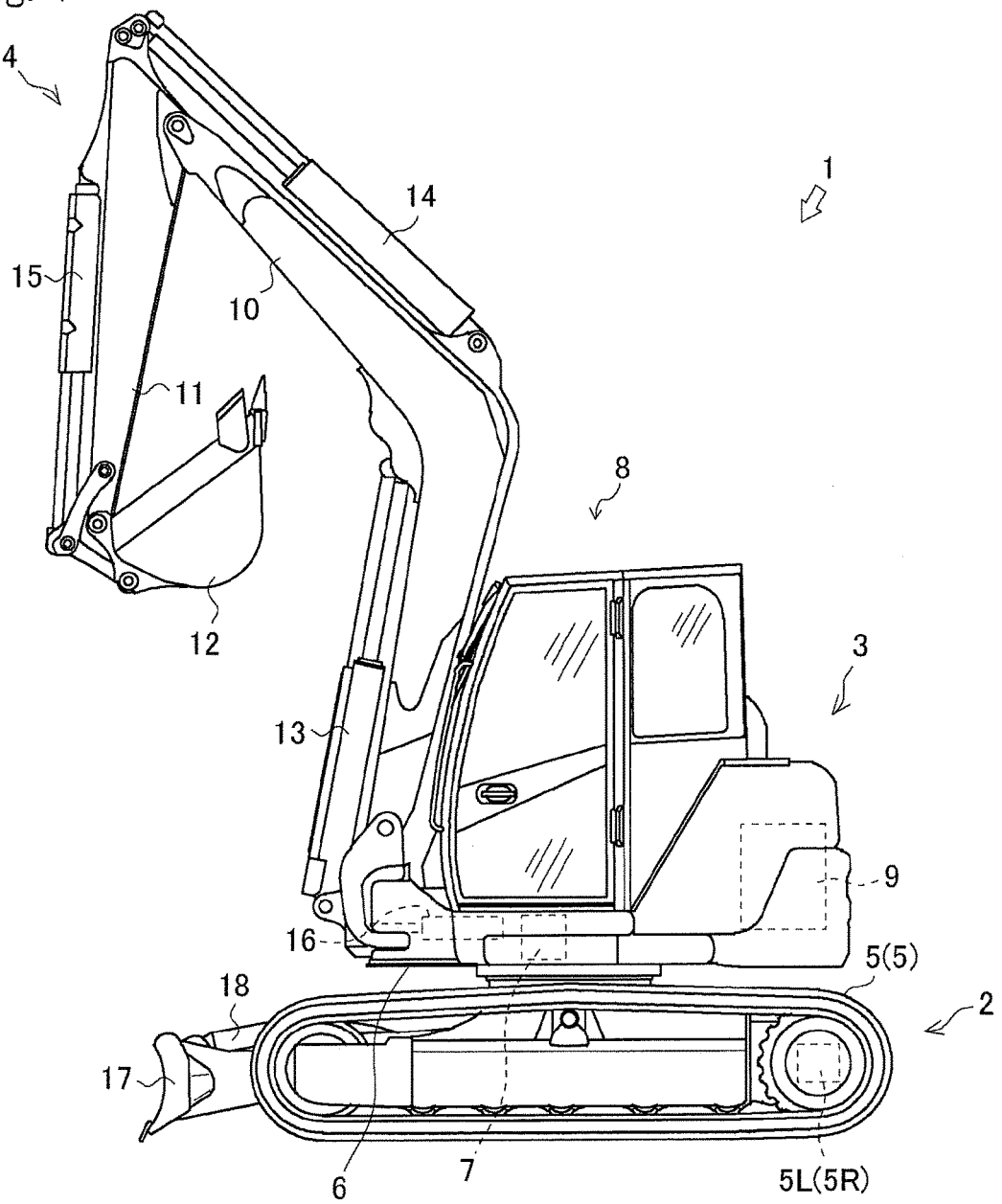
FIG. 1 is a side view of an entire configuration of a turning working vehicle.

As shown in FIG. 1, the turning working vehicle 1 has a traveling device 2, a turning device 3 and a working device 4.

The traveling device 2 has a pair of left and right crawlers 5, a left traveling hydraulic motor 5L and a right traveling hydraulic motor 5R. The left traveling hydraulic motor 5L drives the left crawler 5 and the right traveling hydraulic motor 5R drives the right crawler 5, whereby the traveling device 2 can make the turning working vehicle 1 travel forward and backward and turn. A blade 17 for leveling work accompanying excavating work is provided in the traveling device 2. The blade 17 is supported at one of front and rear sides of the traveling device 2 so as to be rotatable vertically, and is moved vertically by a blade cylinder 18 which is driven telescopically.

The turning device 3 has a turning base 6, a turning motor 7, an operation part 8 and an engine 9. The turning base 6 is arranged above the traveling device 2 and supported rotatably by the traveling device 2. By driving the turning motor 7, the turning device 3 can make the turning base 6 turn concerning the traveling device 2. On the turning base 6, the operation part 8 having various operation tools, the engine 9 which is a power source, and the like are arranged.

The engine 9 has a droop characteristic with which engine rotation speed is decreased or increased gradually following variation of load. Namely, when the load on the engine 9 is increased, output of the engine 9 is increased and the rotation speed of the engine 9 is decreased according to the droop characteristic. When increase of the load is continued, the load is over the maximum output of the engine and engine stall is caused. Then, the engine stall is prevented by later-discussed control.

The working device 4 has a boom 10, an arm 11, a bucket 12, a boom cylinder 13, an arm cylinder 14, a bucket cylinder 15 and a swing cylinder 16.

One of ends of the boom 10 is supported by a front portion of the turning base 6 so as to be rotatable longitudinally, and the boom 10 is rotated by the boom cylinder 13 which is driven telescopically. Furthermore, the end of the boom 10 is supported via a boom bracket as to be rotatable laterally, and is rotated by the swing cylinder 16 which is driven telescopically.

One of ends of the arm 11 is pivoted on the other end of the boom 10, and the arm 11 is rotated by the arm cylinder 14 which is driven telescopically.

One of ends of the bucket 12 is supported by the other end of the arm 11, and the bucket 12 is rotated by the bucket cylinder 15 which is driven telescopically.

Accordingly, in the working device 4, a multi-articulated structure is configured which excavates earth, sand and the like with the bucket 12.

Though a working device provided in the turning working vehicle 1 according to this embodiment is the working device 4 which performs the excavating work with the bucket 12, the working device is not limited thereto and may alternatively be a similar hydraulic device, such as a working device which has a hydraulic breaker and performs the excavating work.

Next, an explanation will be given on a hydraulic circuit 20 of the hydraulic device in the turning working vehicle 1 referring to FIG. 2.

The hydraulic circuit 20 has four hydraulic pumps 21, 22, 23 and 24, and hydraulic oil is sent from the pumps via a control valve 30 to traveling hydraulic actuators (the traveling hydraulic motors 5L and 5R) and working hydraulic actuators (the turning motor 7 and the cylinders 13, 14, 15, 16 and 18).

The hydraulic pumps 21, 22, 23 and 24 are driven by power from the engine 9 so as to discharge the hydraulic oil. The hydraulic pumps 21 and 22 are variable displacement type hydraulic pumps, and the third pump 23 and the pilot pump 24 are fixed displacement type hydraulic pumps.

The hydraulic oil sent from the first pump 21, the second pump 22 and the third pump 23 is supplied to the hydraulic actuators and then returned to a hydraulic oil tank 19 through a return oil passage 19*a*.

The hydraulic oil discharged from the first pump 21 is sent from an oil passage 21*a* via switching valves 31, 33 and 38 constituting the control valve 30 to the boom cylinder 13, the bucket cylinder 15 and the right traveling hydraulic motor 5R respectively.

The hydraulic oil discharged from the second pump 22 is sent from an oil passage 22*a* via switching valves 32, 34, 35, 36 and 37 constituting the control valve 30 to the arm cylinder 14, the swing cylinder 16, the blade cylinder 18, the turning motor 7 and the left traveling hydraulic motor 5L respectively.

The hydraulic oil discharged from the third pump 23 is sent from an oil passage 23*a* via switching valves 31, 32, 33, 35 and 36 constituting the control valve 30 to the turning motor 7, the boom cylinder 13, the arm cylinder 14, the bucket cylinder 15 and the blade cylinder 18 respectively.

When the switching valves 31, 32, 33, 34, 35, 36, 37 and 38 are switched respectively, the boom cylinder 13, the arm cylinder 14, the bucket cylinder 15, the swing cylinder 16, the blade cylinder 18, the turning motor 7, the right traveling hydraulic motor 5R and the left traveling hydraulic motor 5L are driven respectively.

The oil passage 23*a* at a discharge side of the third pump 23 is branched and connected to an electromagnetic proportional relief valve 43, and the electromagnetic proportional relief valve 43 is controlled so that a relief pressure is reduced when load of the engine 9 is not less than a predetermined value.

[Embodiment 1]

Figure 3:
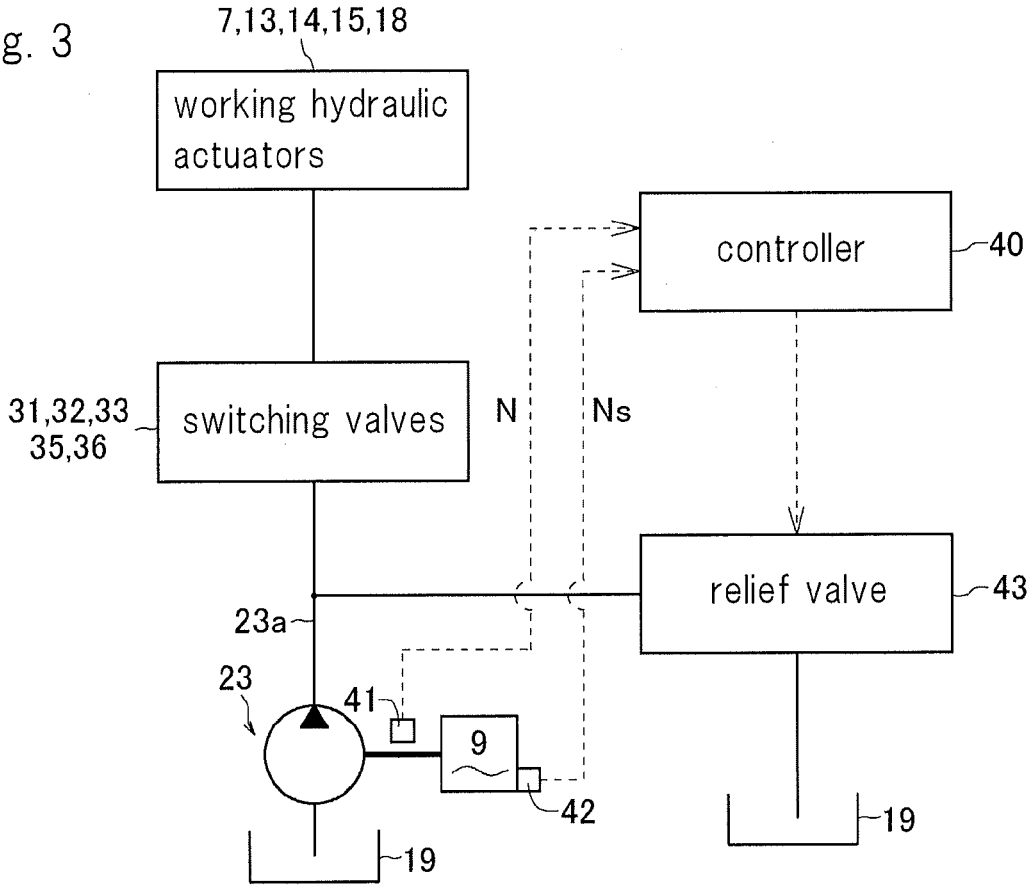
FIG. 3 is a diagram of a control configuration of a turning working vehicle according to a first embodiment.
Figure 4:
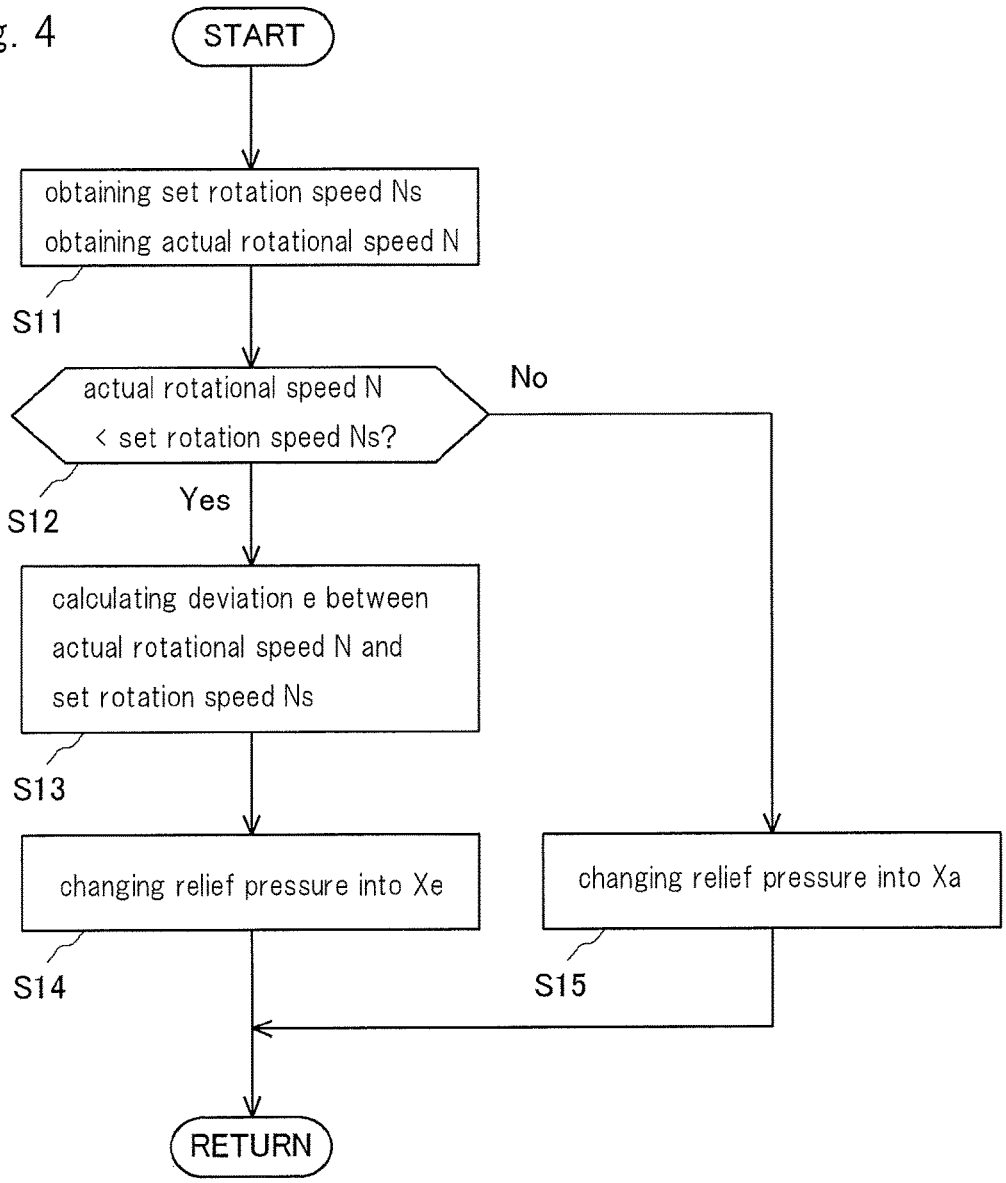
FIG. 4 is a flow chart of the control configuration of the turning working vehicle according to the first embodiment.

An explanation will be given on a control configuration and a control mode of the turning working vehicle 1 according to a first embodiment of the present invention referring to FIGS. 3 and 4.

An engine rotation speed detection means 41 detects an actual rotational speed N of the engine 9. The engine rotation speed detection means 41 includes a sensor such as an electromagnetic pickup or a rotary encoder and is provided near an output shaft of the engine 9. The engine rotation speed detection means 41 is connected to a controller 40 and transmits a detection signal to the controller 40.

The rotation speed of the engine is set by rotating an accelerator lever, and a set rotation speed Ns is detected by a rotation angle detection means 42. The rotation angle detection means 42 includes an angle sensor for example, and is provided in a rotation base part of the accelerator lever (not shown). The rotation angle detection means 42 is connected to a controller 40 and transmits a detection signal to the controller 40.

The electromagnetic proportional relief valve 43 is a pressure change means which changes a pressure of hydraulic oil from the third pump 23. A primary side of the electromagnetic proportional relief valve 43 is connected to the oil passage 23*a* and a secondary side of the electromagnetic proportional relief valve 43 is connected to the hydraulic oil tank 19. The electromagnetic proportional relief valve 43 is configured so that a relief pressure (relief amount) of the hydraulic oil is changed by changing current supplied to a solenoid. The solenoid of the electromagnetic proportional relief valve 43 is connected to the controller 40, and the relief pressure is changed by a control signal from the controller 40.

In the controller 40 of this embodiment, governor control is performed when the load of the engine 9 is less than a predetermined value, and the relief pressure is controlled corresponding to the magnitude of the load when the load is not less than the predetermined value. The said load is found from a map with a difference between the set rotation speed Ns and the actual rotational speed N of the engine 9, and the relief pressure of the electromagnetic proportional relief valve 43 is changed corresponding to the load. Concretely, a flow shown in FIG. 4 is performed.

At a step S11, the controller 40 obtains the set rotation speed Ns and the actual rotational speed N of the engine 9. Then, the control is shifted to a step S12.

At the step S12, the controller 40 judges whether the actual rotational speed N of the engine 9 is lower than the set rotation speed Ns or not. When the actual rotational speed N is lower, the control is shifted to a step S13. When not lower, the control is shifted to a step S15.

At the step S13, the controller 40 calculates a deviation e between the set rotation speed Ns and the actual rotational speed N of the engine 9. Then, the control is shifted to a step S14.

At the step S14, the controller 40 changes the relief pressure of the electromagnetic proportional relief valve 43 into a relief pressure Xe corresponding to the calculated deviation e. Namely, the controller 40 calculates the load from the deviation e and the actual rotational speed N, and when the load is not less than the predetermined value, the controller 40 calculates the relief pressure Xe corresponding to the deviation e and transmits a control signal to the solenoid of the electromagnetic proportional relief valve 43 so as to change the relief pressure into Xe. Then, the pressure of the hydraulic oil from the third pump 23 is changed into the relief pressure Xe from a relief pressure Xa of the case in which the load is less than the predetermined value, and the hydraulic oil excessing the relief pressure Xe is returned to the hydraulic oil tank 19. Accordingly, the load of the engine 9 caused by the third pump 23 corresponding to energy of the difference of Xa and Xe can be reduced. Then, the control is shifted to RETURN and the flow is repeated.

The larger the load is, the lower the relief pressure Xe is set so as to prevent the engine stall.

At the step S15, the controller 40 changes the relief pressure of the electromagnetic proportional relief valve 43 into the relief pressure Xa. Namely, the controller 40 transmits a current command corresponding to the relief pressure Xa to the electromagnetic proportional relief valve 43. Accordingly, the pressure of the hydraulic oil from the third pump 23 is changed into the relief pressure Xa, and the hydraulic oil excessing the relief pressure Xa is returned to the hydraulic oil tank 19. Then, the control is shifted to RETURN and the flow is repeated.

As the above, in the turning working vehicle 1 according to the first embodiment of the present invention, when the load of the engine 9 is increased and the actual rotational speed N of the engine 9 becomes lower than the set rotation speed Ns, the electromagnetic proportional relief valve 43 which is the pressure change means is operated corresponding to the deviation e between the actual rotational speed N and the set rotation speed Ns so that the pressure of the hydraulic oil from the third pump 23 is changed. In more detail, the relief pressure of the electromagnetic proportional relief valve 43 is changed from the relief pressure Xa into the relief pressure Xe lower than the relief pressure Xa, whereby the pressure of the hydraulic oil from the third pump 23 is reduced. Accordingly, the load of the engine 9 caused by the third pump 23 which is the fixed displacement type hydraulic pump can be reduced so as to improve the effect of preventing the engine stall. Furthermore, the load of the engine 9 caused by the third pump 23 can be reduced by not changing the third pump 23 from the fixed displacement type hydraulic pump to the variable displacement type hydraulic pump but providing the pressure change means, whereby cost is reduced.

The pressure change means of this embodiment is configured by the electromagnetic proportional relief valve 43, thereby being matched easily with the controller 40.

[Embodiment 2]

An explanation will be given on a control configuration and a control mode of the turning working vehicle 1 according to a second embodiment of the present invention referring to FIGS. 5 to 8. Points different from the first embodiment are mainly explained.

In the second embodiment, in addition to the control of the first embodiment in which the pressure of the hydraulic oil from the third pump 23 is changed, control in which a flow rate of hydraulic oil discharged from the hydraulic pumps 21 and 22 is changed, that is, control in which a swash plate angle R of a movable swash plate in each of the hydraulic pumps 21 and 22 is changed is performed.

Figure 5:
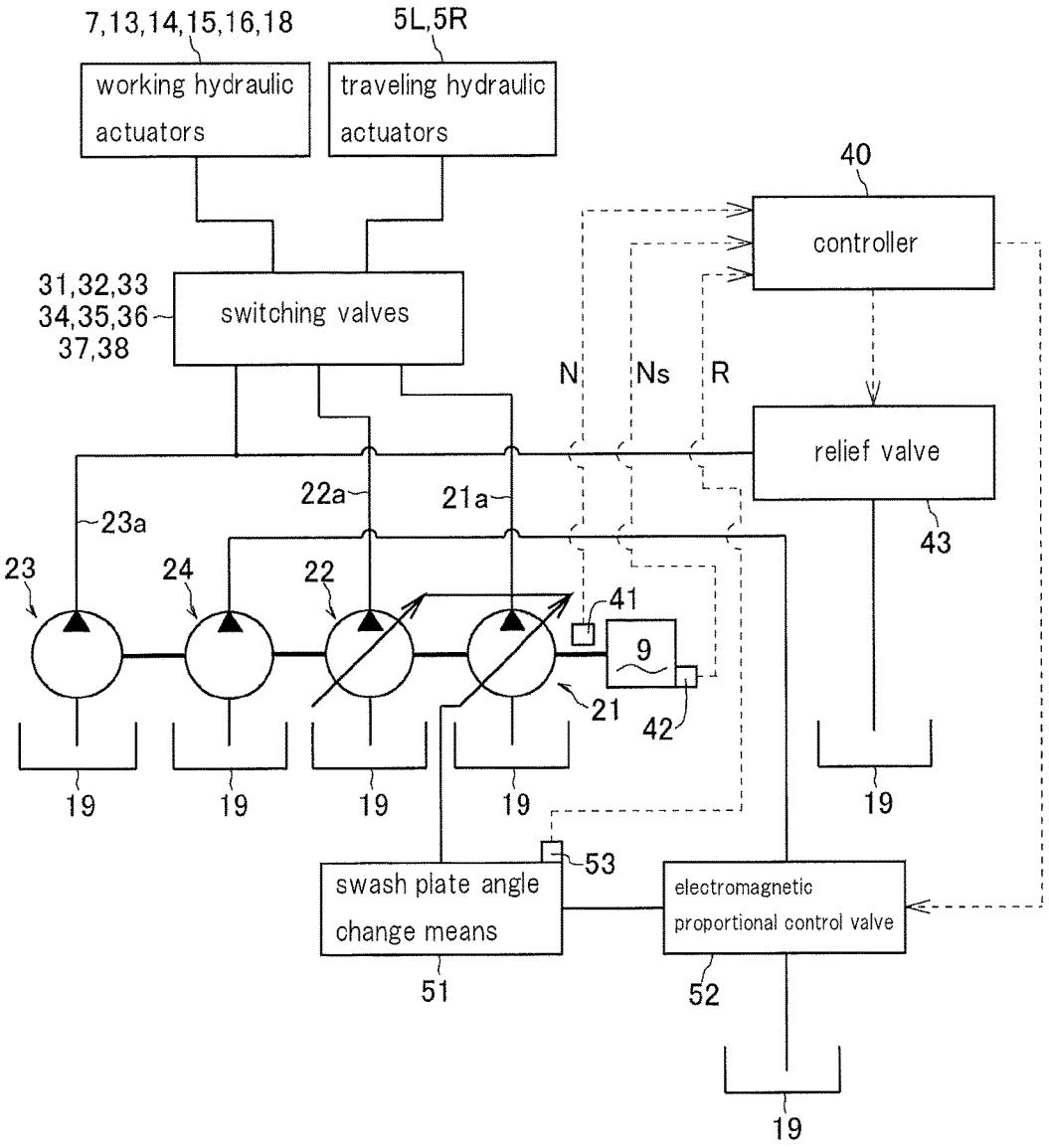
FIG. 5 is a diagram of a control configuration of a turning working vehicle according to a second embodiment.

An explanation will be given on the control in which the swash plate angle of the movable swash plate in each of the hydraulic pumps 21 and 22 is changed. As shown in FIG. 5, the swash plate of the first pump 21 is interlockingly connected to the swash plate of the second pump 22, and the swash plate angle R of the swash plate of the first pump 21 can be changed by a swash plate angle change means 51.

Figure 2:
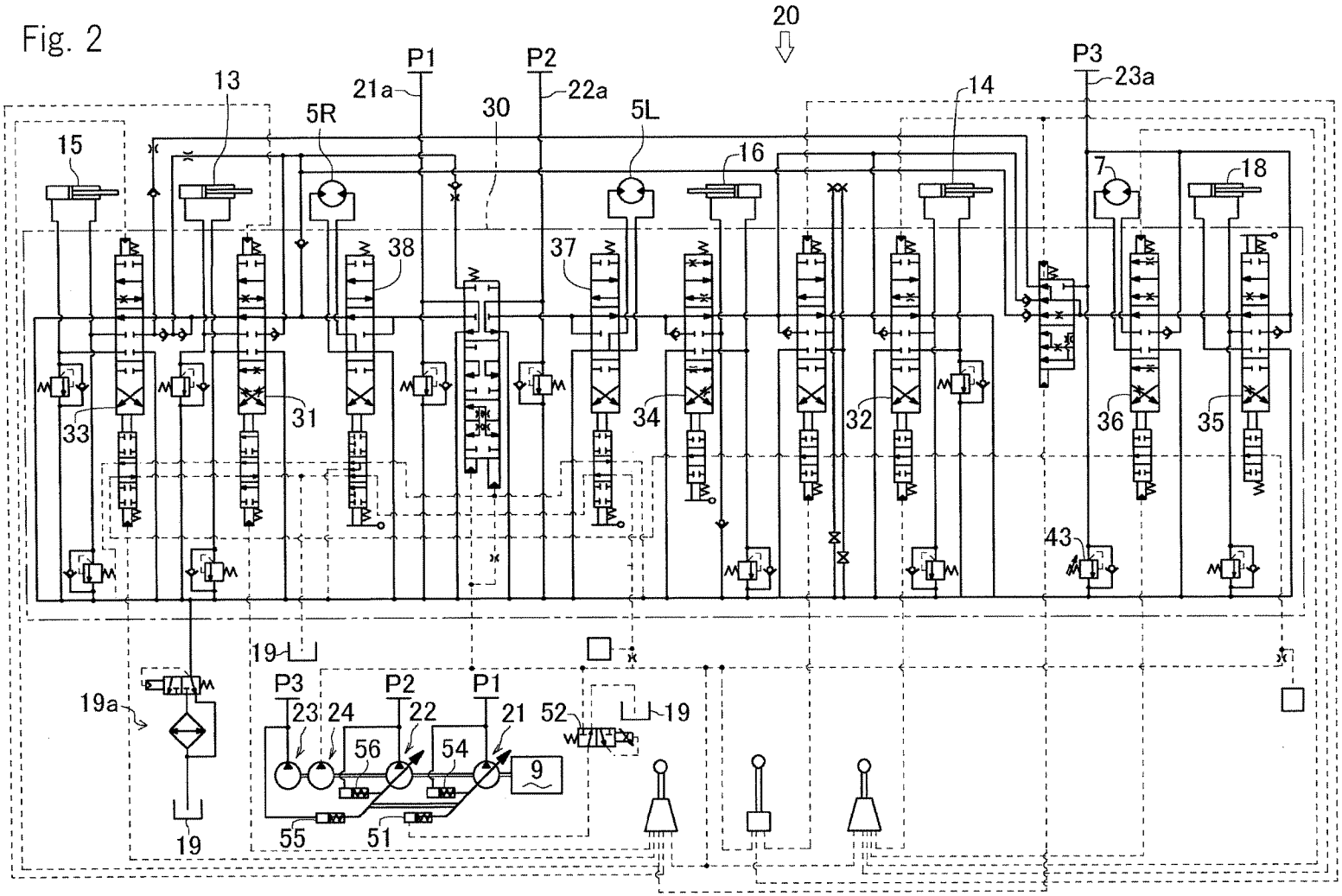
FIG. 2 is a hydraulic circuit diagram of a hydraulic device.

In this embodiment, the swash plate angle change means 51 includes a hydraulic cylinder (FIG. 2). The swash plate angle change means 51 is connected to the swash plate of the first pump 21 and is actuated by operating an electromagnetic proportional control valve 52.

The electromagnetic proportional control valve 52 includes an electromagnetic valve having three parts and two positions (see FIG. 2) which supplies hydraulic oil from the pilot pump 24 to the swash plate angle change means 51 and discharges the hydraulic oil from the swash plate angle change means 51. The electromagnetic proportional control valve 52 is provided between the pilot pump 24 and the swash plate angle change means 51. The electromagnetic proportional control valve 52 is configured so that by changing a current flowing in a solenoid, a flow rate of the hydraulic oil flowing in the electromagnetic proportional control valve 52 is changed proportionally to the current. The electromagnetic proportional control valve 52 is connected to the controller 40, and the flow rate is changed corresponding to a signal from the controller 40 (current command).

A swash plate angle detection means 53 detects the swash plate angle R of the swash plate of the hydraulic pumps 21 and 22. The swash plate angle detection means 53 includes a position sensor for example, and is provided in the swash plate angle change means 51. The swash plate angle detection means 53 is connected to the controller 40 and transmits a detection signal to the controller 40.

Figure 6:
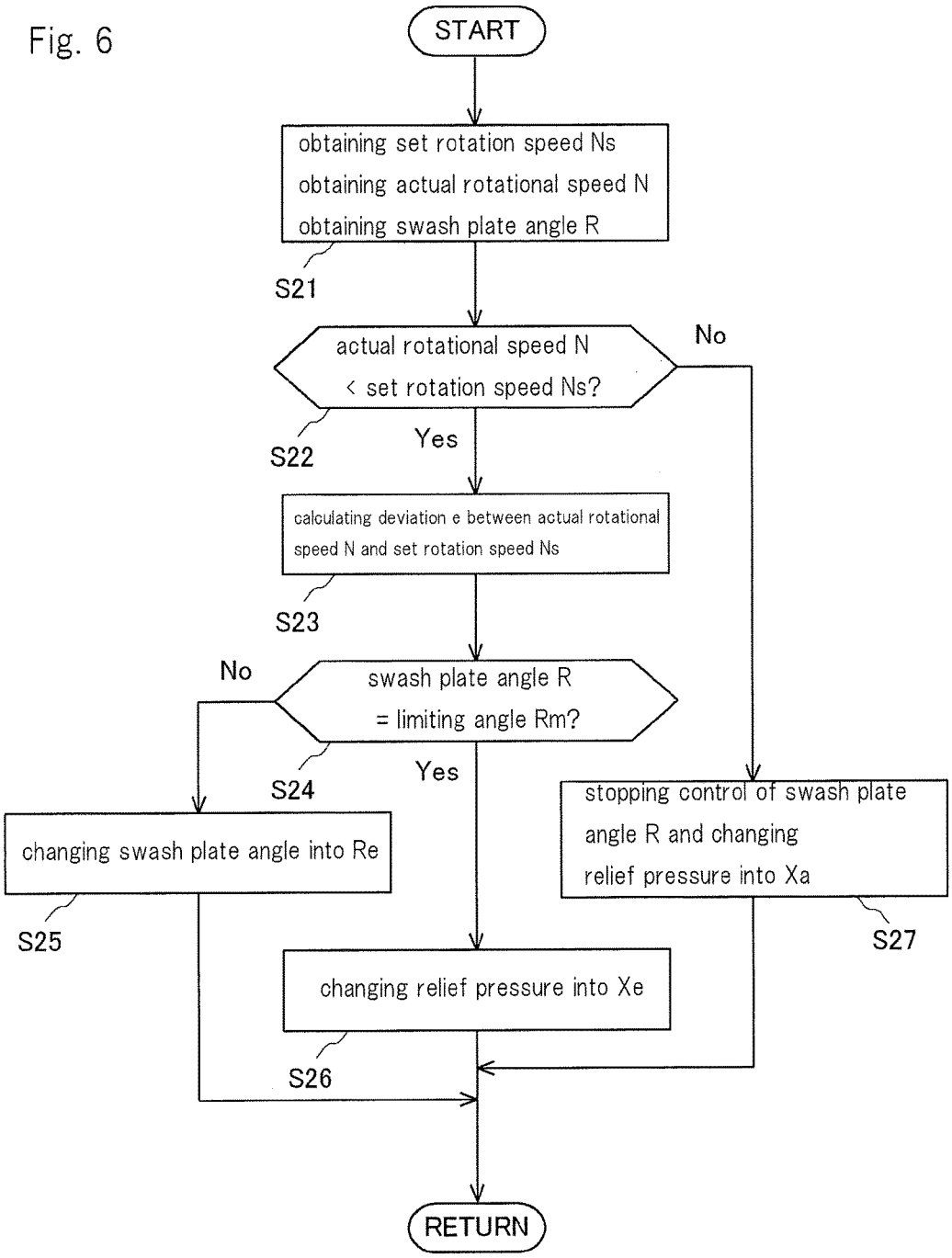
FIG. 6 is a flow chart of the control configuration of the turning working vehicle according to the second embodiment.

In the controller 40 of this embodiment, when the load of the engine 9 is less than the predetermined value, governor control is performed, and when the load is not less than the predetermined value, the relief pressure of the electromagnetic proportional relief valve 43 and the swash plate angle of the swash plate of the hydraulic pumps 21 and 22 are controlled corresponding to the magnitude of the load. The load is found from the difference between the set rotation speed Ns and the actual rotational speed N of the engine 9 with the map, and the relief pressure of the electromagnetic proportional relief valve 43 and the swash plate angle of the swash plate of the hydraulic pumps 21 and 22 are changed corresponding to the load. Concretely, a flow shown in FIG. 6 is performed.

At a step S21, the controller 40 obtains the set rotation speed Ns and the actual rotational speed N of the engine 9 and the swash plate angle R of the swash plate of the hydraulic pumps 21 and 22. Then, the control is shifted to a step S22.

The step S22 is similar to the step S12 of the first embodiment. When the actual rotational speed N of the engine 9 is lower than the set rotation speed Ns, the control is shifted to a step S23. When not lower, the control is shifted to a step S27.

The step S23 is similar to the step S13 of the first embodiment. Then, the control is shifted to a step S24.

At the step S24, the controller 40 judges whether the swash plate angle R of the swash plate of the hydraulic pumps 21 and 22 is a limiting angle Rm or not. The limiting angle Rm is a limiting angle of the swash plate at which the discharge amount of the hydraulic oil from the hydraulic pumps 21 and 22 is the minimum. When the swash plate angle R is the limiting angle Rm, the control is shifted to a step S26. When the swash plate angle R is not the limiting angle Rm, the control is shifted to a step S25.

At the step S25, the controller 40 changes the swash plate angle R of the swash plate of the hydraulic pumps 21 and 22 into a swash plate angle Re corresponding to the deviation e. Namely, the controller 40 operates the electromagnetic proportional control valve 52 so that the hydraulic oil discharged from the pilot pump 24 is supplied to and discharged from the swash plate angle change means 51, whereby the swash plate angle is changed into the swash plate angle Re and the discharge amount of the hydraulic oil from the hydraulic pumps 21 and 22 is changed to a discharge amount corresponding to the swash plate angle Re. Then, the control is shifted to RETURN and the flow is repeated.

At the step S26, the controller 40 acts similarly to the step S14 of the first embodiment. Then, the control is shifted to RETURN and the flow is repeated.

At the step S27, the controller 40 stops the control of the swash plate angle R of the swash plate of the hydraulic pumps 21 and 22 with the swash plate angle change means 51 and the electromagnetic proportional control valve 52, and changes the relief pressure of the electromagnetic proportional relief valve 43 into Xa. Then, the control is shifted to RETURN and the flow is repeated.

The swash plate angle R of the swash plate of the hydraulic pumps 21 and 22 can be changed with not only the swash plate angle change means 51 but also three swash plate angle change means 54, 55 and 56 (see FIG. 2) which are operated corresponding to the flow rate of the hydraulic oil discharged from the hydraulic pumps 21, 22 and 23. Accordingly, when the control is stopped at the step, the swash plate angle R is changed corresponding to the discharge amount of the hydraulic oil discharged from the hydraulic pumps 21, 22 and 23.

As the above, in the turning working vehicle 1 according to the second embodiment of the present invention, when the load of the engine 9 is increased and the actual rotational speed N of the engine 9 becomes lower than the set rotation speed Ns, the swash plate angle change means 51 is operated corresponding to the deviation e between the actual rotational speed N and the set rotation speed Ns so that the swash plate angle R of the swash plate of the hydraulic pumps 21 and 22 is changed into the swash plate angle Re, and when the swash plate angle Re is the limiting angle Rm, the electromagnetic proportional relief valve 43 which is the pressure change means is operated corresponding to the deviation e so that the pressure of the hydraulic oil from the third pump 23 is changed. In more detail, the relief pressure of the electromagnetic proportional relief valve 43 is changed from the relief pressure Xa into the relief pressure Xe lower than the relief pressure Xa, whereby the pressure of the hydraulic oil from the third pump 23 is reduced. Accordingly, the load of the engine 9 caused by the third pump 23 and the load of the engine 9 caused by the first pump 21 and the second pump 22 can be reduced. Therefore, the effect of preventing the engine stall is improved further. In comparison with the first embodiment, the pressure of the hydraulic oil from the third pump 23 is not reduced excessively, whereby balance of the work is not lost and working ability is not reduced.

Figure 7:
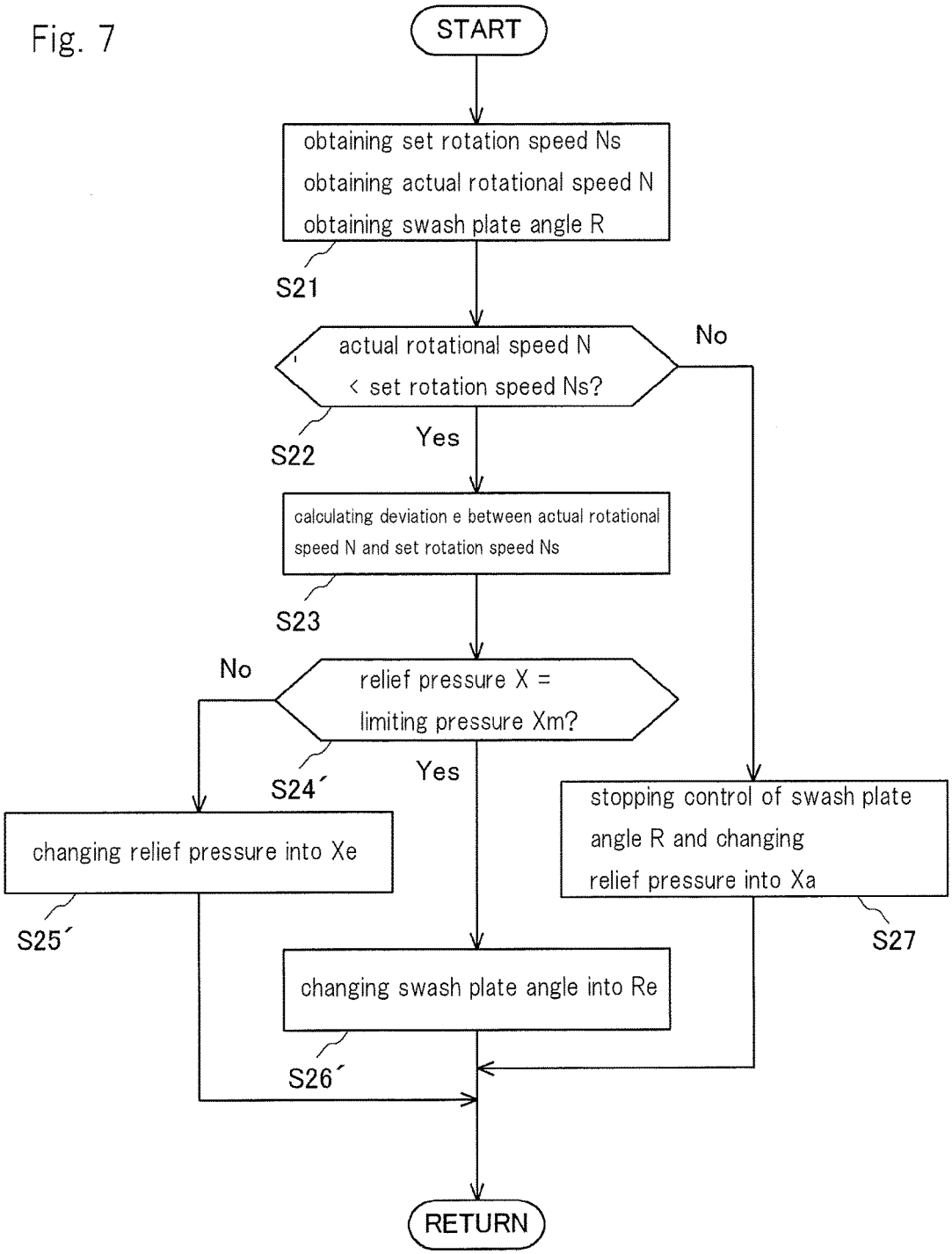
FIG. 7 is a flow chart of another control configuration of the turning working vehicle according to the second embodiment.

As shown in a flow in FIG. 7, in the controller 40, when the load of the engine 9 is increased and the actual rotational speed N of the engine 9 becomes lower than the set rotation speed Ns, the relief pressure of the electromagnetic proportional relief valve 43 is changed corresponding to the deviation e between the actual rotational speed N and the set rotation speed Ns, and when the relief pressure X becomes a limiting pressure Xm (a limiting pressure at which the pressure of the hydraulic oil from the third pump 23 is the minimum), the swash plate angle R of the swash plate of the hydraulic pumps 21 and 22 can be changed so as to change the discharge amount of the hydraulic pumps 21 and 22.

Figure 8:
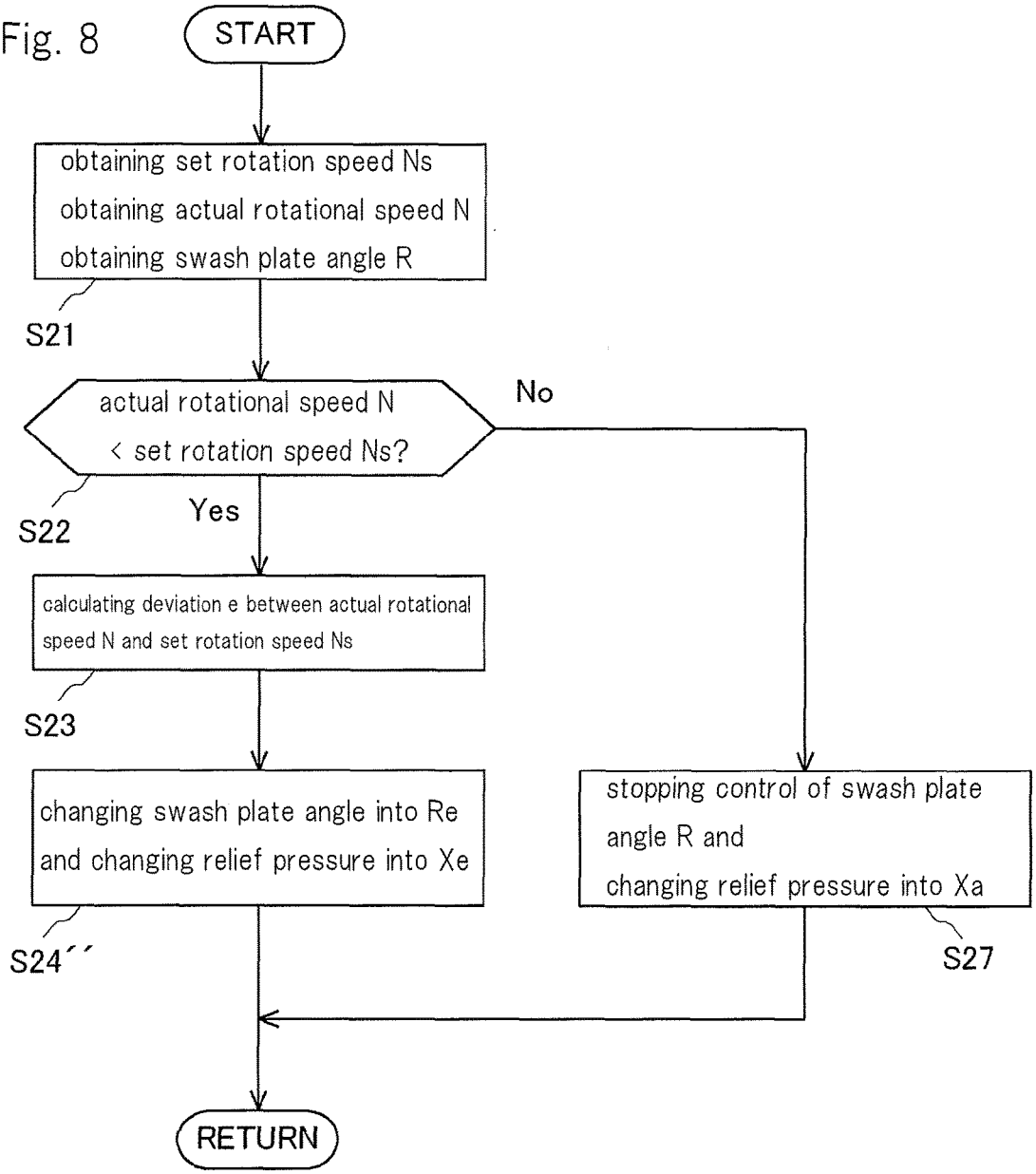
FIG. 8 is a flow chart of another control configuration of the turning working vehicle according to the second embodiment.

Furthermore, as shown in a flow in FIG. 8, in the controller 40, when the load of the engine 9 is increased and the actual rotational speed N of the engine 9 becomes lower than the set rotation speed Ns, the relief pressure of the electromagnetic proportional relief valve 43 and the swash plate angle of the swash plate of the hydraulic pumps 21 and 22 can be changed simultaneously corresponding to the deviation e between the actual rotational speed N and the set rotation speed Ns so as to change the pressure of the hydraulic oil from the third pump 23 and the discharge amount of the hydraulic pumps 21 and 22 simultaneously. In this case, the load of the engine 9 caused by the hydraulic pumps 21, 22 and 23 is dispersed, whereby the balance of the work is not lost and the working ability is not reduced.

[Embodiment 3]

Figure 9:
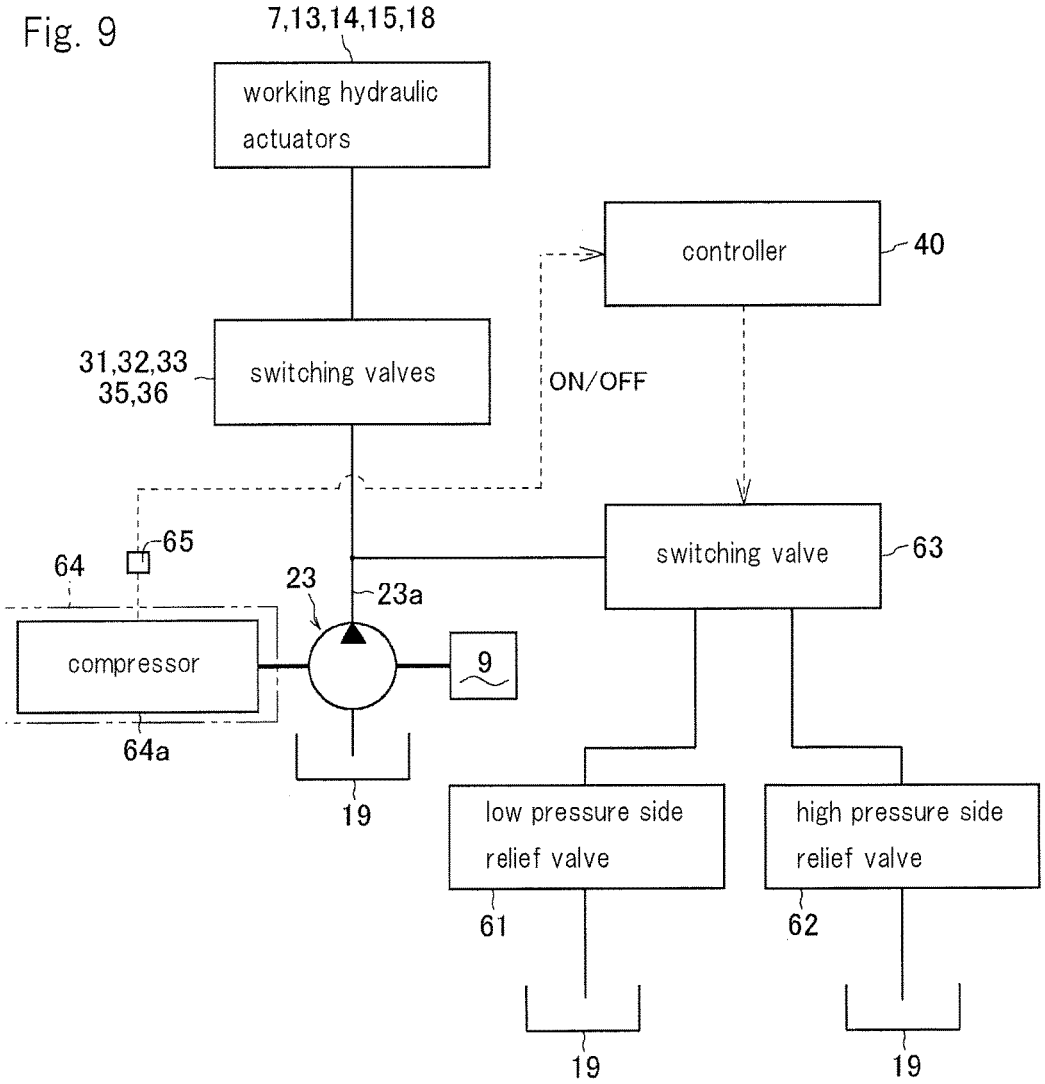
FIG. 9 is a diagram of a control configuration of a turning working vehicle according to a third embodiment.
Figure 10:
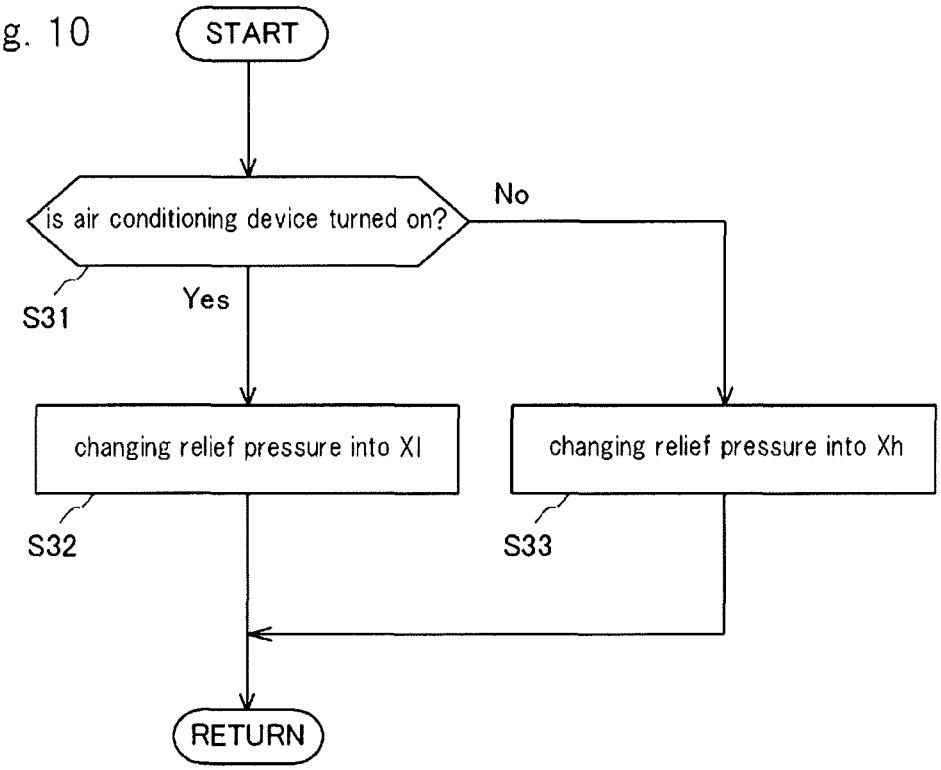
FIG. 10 is a flow chart of the control configuration of the turning working vehicle according to the third embodiment.

An explanation will be given on a control configuration and a control mode of the turning working vehicle 1 according to a third embodiment of the present invention referring to FIGS. 9 and 10. Points different from the first and second embodiments are mainly explained.

Different from the turning working vehicle 1 of the first and second embodiments configured so that the load of the engine 9 is detected and the pressure of the hydraulic oil from the third pump 23 is changed, the turning working vehicle 1 according to the third embodiment is configured so that application of the load on the engine 9 is predicted beforehand and the pressure of the hydraulic oil from the third pump 23 is changed. According to this embodiment, the pressure change means changing the pressure of the hydraulic oil from the third pump 23 includes a low pressure side relief valve 61, a high pressure side relief valve 62 and a switching valve 63.

The low pressure side relief valve 61 reduces the pressure of the hydraulic oil from the third pump 23. A suction port of the low pressure side relief valve 61 is connected via the switching valve 63 to a discharge port of the third pump 23. A discharge port of the low pressure side relief valve 61 is connected to the hydraulic oil tank 19. A relief pressure of the low pressure side relief valve 61 is set to Xl of the low pressure side.

The high pressure side relief valve 62 increases the pressure of the hydraulic oil from the third pump 23. A suction port of the high pressure side relief valve 62 is connected via the switching valve 63 to a discharge port of the third pump 23. A discharge port of the high pressure side relief valve 62 is connected to the hydraulic oil tank 19. A relief pressure of the high pressure side relief valve 62 is set to Xh of the high pressure side.

The switching valve 63 switches an oil passage which guides the hydraulic oil discharged from the third pump 23 to the low pressure side relief valve 61 and an oil passage which guides the hydraulic oil discharged from the third pump 23 to the high pressure side relief valve 62. The switching valve 63 is provided between the third pump 23 and the low pressure side relief valve 61 and the high pressure side relief valve 62. The switching valve 63 is an electromagnetic switching valve and is connected to the controller 40 and switches the oil passages following a signal from the controller 40.

An air conditioning device 64 conditions air in a cabin covering the operation part 8. The air conditioning device 64 includes a compressor 64*a*, a receiver dryer, an expansion valve, an evaporator and the like. The compressor 64*a* of the air conditioning device 64 is provided on the output shaft of the engine 9 and is driven by power from the engine 9.

An air conditioning operation tool 65 is a means for operating the air conditioning device 64. The air conditioning operation tool 65 is provided in the operation part 8. The air conditioning operation tool 65 includes an ON-OFF switch, a temperature control lever, an airflow control knob and the like. The ON-OFF switch of the air conditioning operation tool 65 is connected to the controller 40 and transmits a detection signal (ON-OFF signal) to the controller 40. Instead of the ON-OFF switch of the air conditioning operation tool 65, a detection means detecting operation of the compressor 64*a* may alternatively be provided and connected to the controller 40.

The controller 40 operates the switching valve 63 following on-off operation of the air conditioning device 64 (operation of the ON-OFF switch of the air conditioning operation tool 65). Concretely, a flow shown in FIG. 10 is performed.

At a step S31, the controller 40 judges whether the air conditioning device 64 is turned on or not, that is, whether the ON-OFF switch of the air conditioning operation tool 65 is ON or not. When the ON-OFF switch is ON, the control is shifted to a step S32. When the ON-OFF switch is not ON, the control is shifted to a step S33.

At the step S32, the controller 40 changes the relief pressure X into Xl. Namely, the switching valve 63 is switched and the hydraulic oil discharged from the third pump 23 is supplied to the low pressure side relief valve 61. Accordingly, the pressure of the hydraulic oil from the third pump 23 is changed into the relief pressure Xl. Therefore, the hydraulic oil excessing the relief pressure Xl is returned to the hydraulic oil tank 19. Then, the control is shifted to RETURN and the flow is repeated.

At the step S33, the controller 40 changes the relief pressure X into Xh. Namely, the switching valve 63 is switched and the hydraulic oil discharged from the third pump 23 is supplied to the high pressure side relief valve 62. Accordingly, the pressure of the hydraulic oil from the third pump 23 is changed into the relief pressure Xh. Therefore, the hydraulic oil excessing the relief pressure Xh is returned to the hydraulic oil tank 19. Then, the control is shifted to RETURN and the flow is repeated.

Accordingly, when the air conditioning device 64 is turned on, the pressure of the hydraulic oil from the third pump 23 is changed from the relief pressure Xh of the high pressure side into the relief pressure Xl of the low pressure side, whereby the load of the engine 9 caused by the third pump 23 can be reduced for a difference between Xh and Xl. Therefore, when the compressor 64*a* of the air conditioning device 64 is driven, the engine stall can be prevented.

The pressure change means may alternatively be the electromagnetic proportional relief valve shown in the first embodiment so as to change the relief pressure continuously corresponding to a set temperature of the air conditioning device 64 or the like.

As the above, in the turning working vehicle 1 according to the third embodiment of the present invention, the pressure change means is operated following on-off operation of the air conditioning device 64 (operation of the ON-OFF switch of the air conditioning operation tool 65) so as to change the pressure of the hydraulic oil from the third pump 23. In detail, interlocking with the turning-on operation of the air conditioning device 64, the switching valve 63 is operated so as to make the hydraulic oil from the third pump 23 flow to the low pressure side relief valve 61, whereby the pressure of the hydraulic oil from the third pump 23 is reduced, and interlocking with the turning-off operation of the air conditioning device 64, the switching valve 63 is operated so as to make the hydraulic oil from the third pump 23 flow to the high pressure side relief valve 62, whereby the pressure of the hydraulic oil from the third pump 23 is increased. Accordingly, by reducing the pressure of the hydraulic oil from the third pump 23 by the turning-on operation of the air conditioning device 64, the load of the engine 9 caused by the third pump 23 can be reduced, whereby the effect of preventing the engine stall is improved.

[Embodiment 4]

An explanation will be given on a circumference configuration of an engine 110 according to a fourth embodiment of the present invention referring to FIG. 11.

Figure 11:
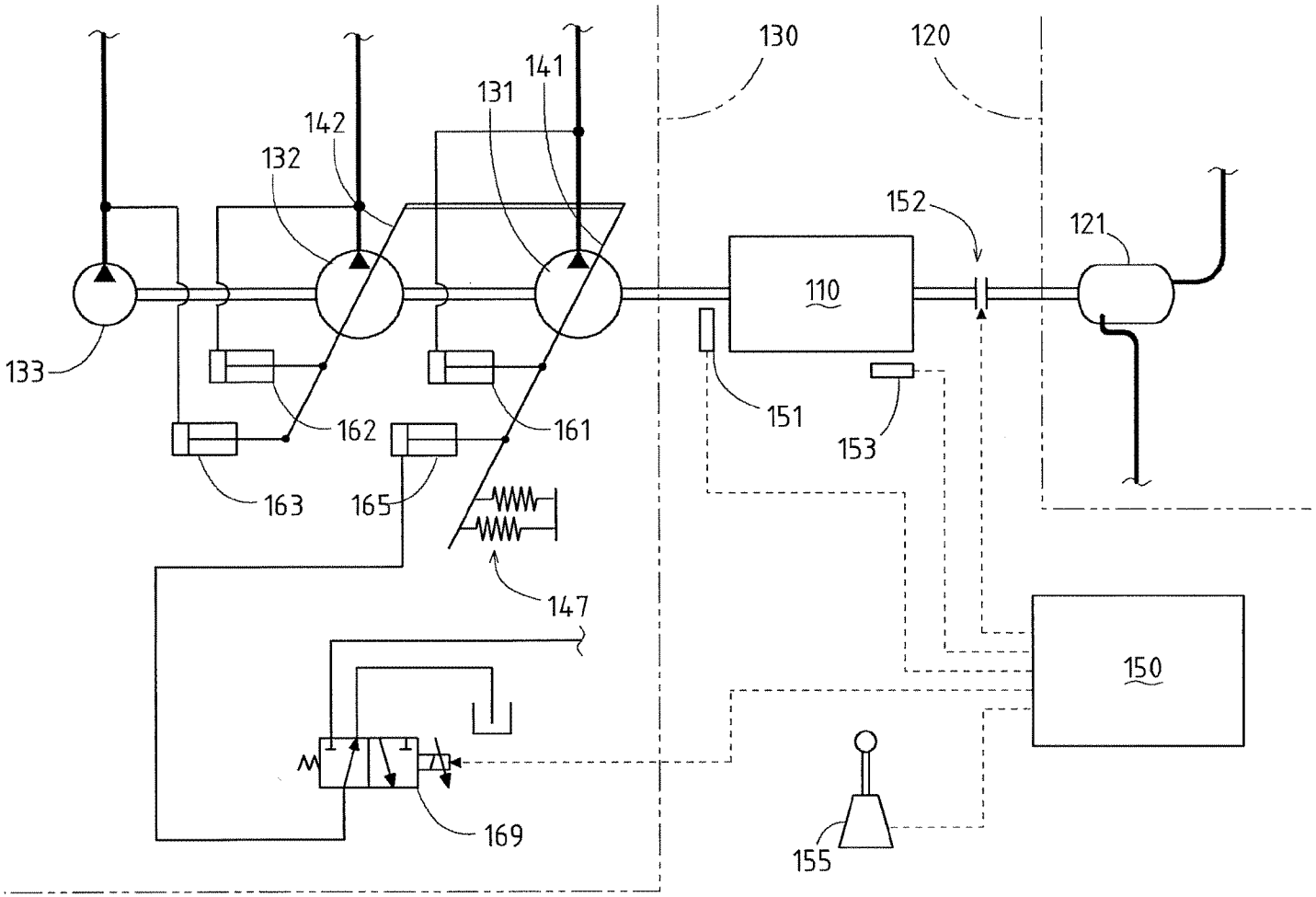
FIG. 11 is a diagram of a control configuration of a turning working vehicle according to a fourth embodiment.

In FIG. 11, in a hydraulic drive system 130, thick lines show a main circuit and thin lines show a pilot circuit. In FIG. 11, in an air conditioning system 120, thick lines show a coolant circuit. In FIG. 11, dotted lines show electric signal lines.

The engine 110 and the hydraulic drive system 130 of this embodiment are different from those of the first to third embodiments.

In the circumference of the engine 110, a first pump 131 as a hydraulic pump, a second pump 132 as a hydraulic pump, a third pump 133 as a hydraulic pump, a compressor 121, a controller 150 as a control means, a rack actuator 153 as a rotation speed change means, and an accelerator lever 155 as a target rotation speed set means are provided.

An explanation will be given on a configuration of the engine 110.

Figure 12:
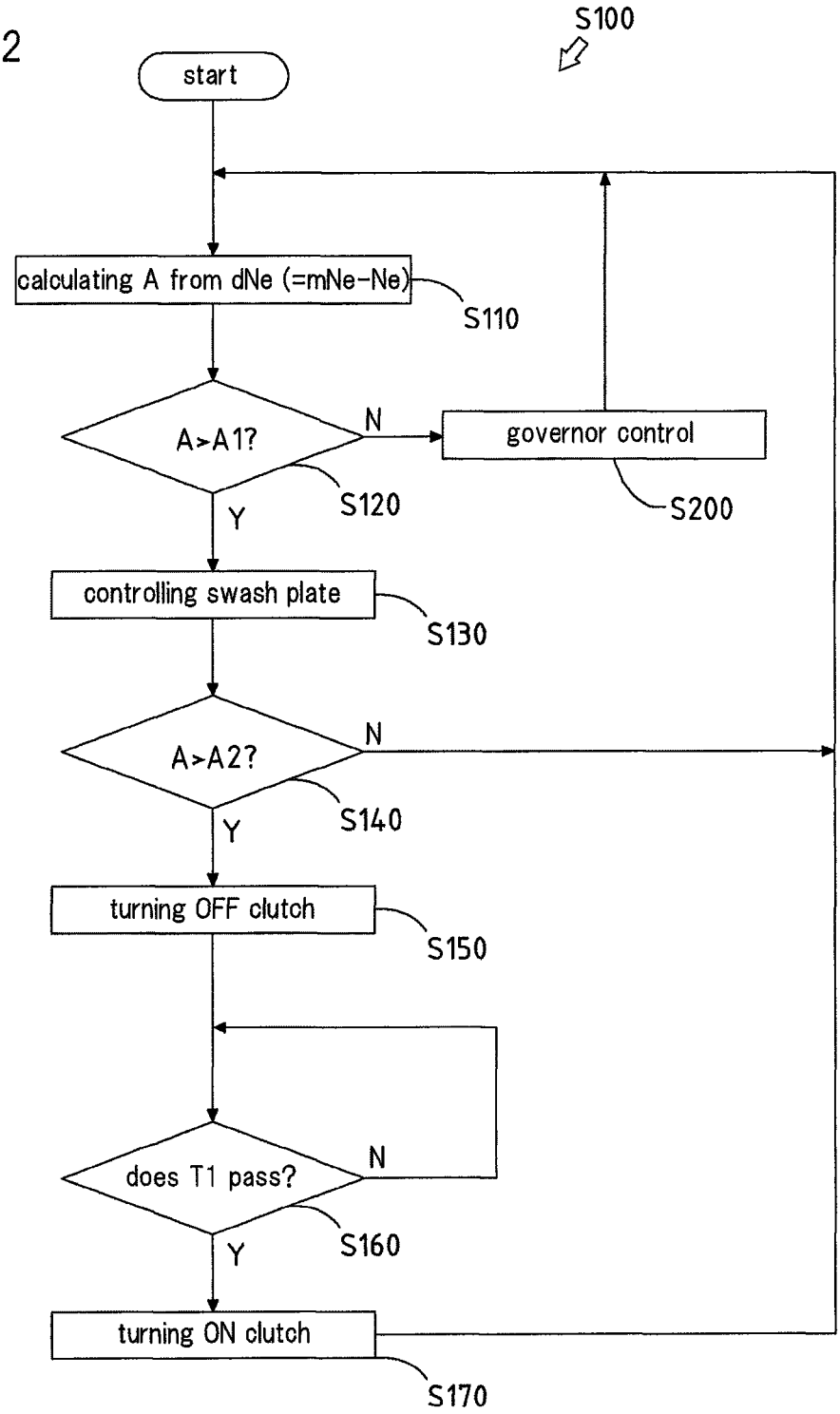
FIG. 12 is a flow chart of the control configuration of the turning working vehicle according to the fourth embodiment.

An output shaft of the engine 110 is connected to an input shaft of the first pump 131, an input shaft of the second pump 132 and an input shaft of the third pump 133 (in this embodiment, the input shaft of the first pump 131, the input shaft of the second pump 132 and the input shaft of the third pump 133 are configured by one shaft, and the shaft is an input shaft 201 in FIG. 12 discussed later), and the first pump 131, the second pump 132 and the third pump 133 are driven by the engine. Furthermore, the output shaft of the engine 110 is connected via a clutch 152 to an input shaft of the compressor 121.

An engine rotation speed sensor 151 as an actual rotation speed detection means is arranged near a crankshaft of the engine 110. The engine rotation speed sensor 151 detects an actual rotation speed Ne of the engine 110. The engine rotation speed sensor 151 is connected to the controller 150.

The engine 110 is controlled so as to realize a target rotation speed, set by the accelerator lever 155, with an electronic governor. In more detail, for realizing the target rotation speed set by the accelerator lever 155, a fuel injection amount is changed and controlled by operation of the rack actuator 153 which is the rotation speed change means. The rack actuator 153 is connected to the controller 150.

An explanation will be given on a configuration of the hydraulic pumps.

The first pump 131, the second pump 132 and the third pump 133 are included in the hydraulic drive system 130. The hydraulic drive system 130 has the left traveling hydraulic motor 5L, the right traveling hydraulic motor 5R, the blade cylinder 18, the boom cylinder 13, the arm cylinder 14, the bucket cylinder 15, and the swing cylinder 16, which are mentioned above, as hydraulic actuators. In the hydraulic drive system 130, the hydraulic pumps suck hydraulic oil stored in a hydraulic oil tank and apply pressure on the hydraulic oil, and then send the hydraulic oil to the hydraulic actuators.

The first pump 131 and the second pump 132 are variable displacement type hydraulic pumps whose discharge amounts of the hydraulic oil can be changed by changing tilt angles of a movable swash plate 141 and a movable swash plate 142. The movable swash plate 141 and the movable swash plate 142 are configured integrally. Namely, the first pump 131 and the second pump 132 are configured so that a plurality of plungers are arranged in one cylinder block so as to be movable reciprocally, one suction port and two discharge ports are formed, the plungers contact with one swash plate, and the discharge amounts are changed simultaneously. The third pump 133 is a fixed displacement type hydraulic pump which is configured by a trochoid type or gear type pump whose discharge amount is fixed.

The tilt angle of the movable swash plate 141 is limited (controlled) by a spring mechanism 147, a first damper mechanism 161 and a rotation deviation damper mechanism 165. The spring mechanism 147 biases the movable swash plate 141 so as to make the discharge amounts of the first pump 131 and the second pump 132 the maximum discharge amount, that is, to tilt the movable swash plate 141 at a predetermined tilt angle. The first damper mechanism 161 biases the movable swash plate 141 so as to control the discharge amounts of the first pump 131 and the second pump 132 corresponding to the discharge amount of the first pump 131, that is, to control the tilt angle of the movable swash plate 141.

The tilt angle of the movable swash plate 142 is limited by a second damper mechanism 162 and a third damper mechanism 163. The second damper mechanism 162 biases the movable swash plate 142 so as to control the discharge amounts of the first pump 131 and the second pump 132 corresponding to the discharge amount of the second pump 132, that is, to control the tilt angle of the movable swash plate 142. The third damper mechanism 163 biases the movable swash plate 142 so as to control the discharge amounts of the first pump 131 and the second pump 132 corresponding to the discharge amount of the third pump 133, that is, to control the tilt angle of the movable swash plate 142.

An electromagnetic proportional control valve 169 controls a pilot pressure from a pilot pump (not shown) to the rotation deviation damper mechanism 165. A solenoid which is a switching operation part of the electromagnetic proportional control valve 169 is connected to the controller 150.

An explanation will be given on a configuration of the compressor 121.

The compressor 121 is included in the air conditioning system 120. The air conditioning system 120 has an outdoor heat exchanger, an expansion valve and an indoor heat exchanger (not shown). The air conditioning system 120 circulates a coolant with the compressor 121 so as to condition air in the operation part 8.

The clutch 152 is interposed between the output shaft of the engine 110 and the input shaft of the compressor 121, and the clutch 152 switches ON (connection) and OFF (disconnection). The clutch 152 includes an electromagnetic clutch and is connected to the controller 150.

The accelerator lever 155 is a means for setting the target rotation speed mNe of the engine 110. The accelerator lever 155 is arranged in the operation part 8. An operation amount (rotation angle) of the accelerator lever 155 is detected by an angle sensor which is an operation amount detection means, and the angle sensor is connected to the controller 150.

The controller 150 controls totally the engine 110, the air conditioning system 120 and the hydraulic drive system 130. The controller 150 is connected to the engine rotation speed sensor 151, the clutch 152, the accelerator lever 155 and the electromagnetic proportional control valve 169.

An explanation will be given on a flow of engine stall avoidance control S100 referring to FIG. 12.

Steps S120 to S130 show steps of speed sensing control.

In the engine 110, for example, when the load of the hydraulic pump is increased, the actual rotation speed Ne of the engine is reduced and the reduction of the actual rotation speed is suppressed to a predetermined amount by the electronic governor until the load reaches a first set value A1 discussed later. When the engine load A is increased further from the first set value A1, until the load reaches a second set value A2, the electromagnetic proportional control valve 169 is operated and the tilt of the movable swash plate 142 is changed so as to reduce the discharge amount of the hydraulic oil of the first pump 131 and the second pump 132. Furthermore, when the engine load excesses the second set value A2, the engine 110 is stalled. Therefore, in the engine stall avoidance control S100, when the engine load A excesses the second set value A2, the clutch 152 has been turned OFF for a predetermined time so as to cut off power transmission to the compressor 121, whereby the engine 110 is prevented from being stalled.

In this embodiment, the engine load is calculated based on the difference between the target rotation speed mNe and the actual rotation speed Ne. However, the detection of the load is not limited to this embodiment, and the load may alternatively be found based on a difference between a target rack position and an actual rack position which change the fuel injection amount, a difference between a target angle and an actual angle of the movable swash plate, or the pressure of the hydraulic oil, for example.

At a step S110, the controller 150 calculates a rotation speed deviation dNe by deducting the actual rotation speed Ne detected by the engine rotation speed sensor 151 from the target rotation speed mNe set with the accelerator lever 155, and calculates the engine load A based on the rotation speed deviation dNe.

At a step S120, in the controller 150, when the rotation speed deviation dNe is increased and the engine load A is larger than the first set value A1, the control is shifted to a step S130. On the other hand, when the engine load A is not larger than the first set value A1, the control is shifted to a step S200, and the rotation speed deviation dNe is controlled toward 0 with governor control.

At the step S130, the controller 150 changes the tilt of the movable swash plate 142 by controlling the pilot pressure with the electromagnetic proportional control valve 169 so as to reduce the discharge amount of the hydraulic oil of the first pump 131 and the second pump 132, that is, to reduce a load torque of the first pump 131 and the second pump 132. The steps S120 to S130 show the steps of the speed sensing control.

At a step S140, the controller 150 judges whether the rotation speed deviation dNe is increased and the engine load A is larger than the second set value A2 after the speed sensing control is performed or not. When the engine load A is larger than the second set value A2, the control is shifted to a step S150.

At the step S150, the controller 150 turns OFF the clutch 152, and the control is shifted to a step S160. At this time, the connection of the engine 110 and the compressor 121 is cut off, whereby the engine load A is reduced.

At the step S160, whether a set time t1 passes after the clutch 152 is turned OFF or not is judged. When the set time t1 passes, the control is shifted to a step S170 and the clutch 152 is turned ON.

An explanation will be given on effect of the engine stall avoidance control S100.

According to the engine stall avoidance control S100, the engine stall can be avoided. Namely, when the rotation speed deviation dNe is increased and the load A is increased after the speed sensing control is performed, the connection of the engine 110 and the compressor 121 is cut off, whereby the load of the engine 110 is reduced and engine output is reduced so as to avoid the engine stall.

An explanation will be given on a left stepped pin 210 and a right stepped pin 220 referring to FIG. 13.

Figure 13A:
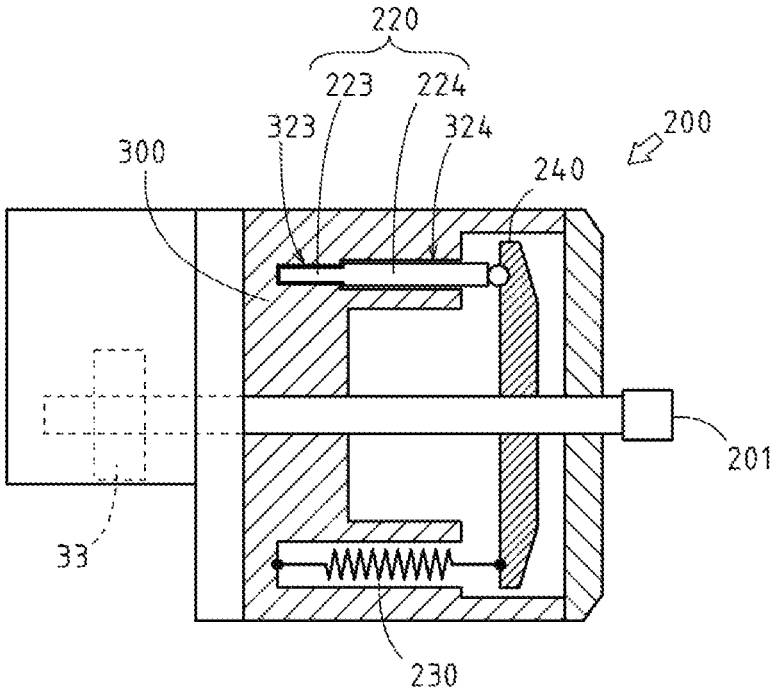
FIGS. 13A and 13B are schematic drawings of a stepped control pin of the turning working vehicle according to the fourth embodiment.

FIG. 13A is a schematic side view partially in section of a pump unit 200.

Figure 13B:
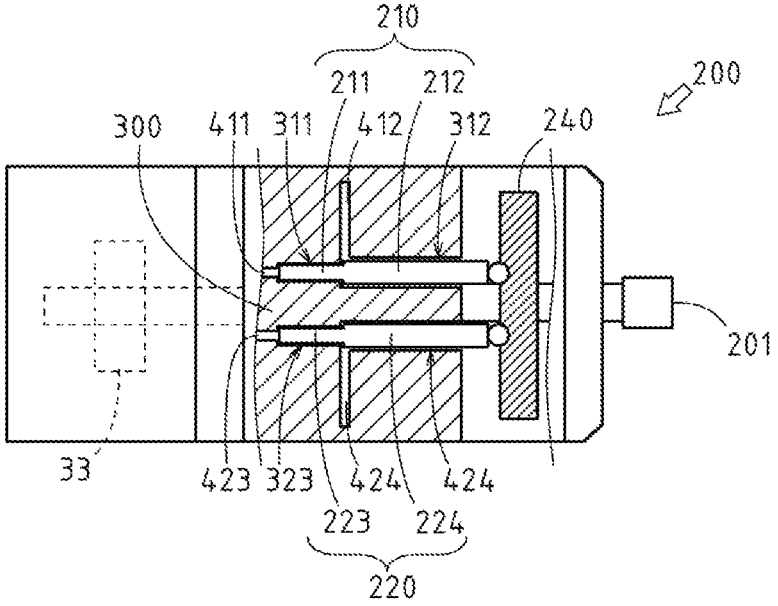

FIG. 13B is a schematic plan view partially in section of the pump unit 200. In FIG. 13, for make the explanation plain, the first pump 131 and the second pump 132 are not shown.

The pump unit 200 is configured by integrating the first pump 131, the second pump 132 and the third pump 133 in one casing 300.

The pump unit 200 has the casing 300, the input shaft 201, plungers of the first pump 131 and the second pump 132 (not shown), the third pump 133, the left stepped pin 210, the right stepped pin 220, a spring mechanism 230 and a swash plate 240.

The swash plate 240 corresponds to the movable swash plate 141 and the movable swash plate 142 in FIG. 11. The spring mechanism 230 corresponds to the spring mechanism 147 in FIG. 11.

The left stepped pin 210 corresponds to the first damper mechanism 161 and the second damper mechanism 162 in FIG. 11. The left stepped pin 210 has a first diameter part (small diameter part) 211 and a second diameter part (large diameter part) 212. The first diameter part 211 is formed at one of ends of the left stepped pin 210. The second diameter part 212 is formed at the other end of the left stepped pin 210, and the other end contacts with the swash plate 240. The second diameter part 212 has larger diameter than the first diameter part 211.

In the casing 300, spaces in which the left stepped pin 210 is housed are formed. In a first space 311, the first diameter part 211 of the left stepped pin 210 is housed. In a second space 312, the second diameter part 212 of the left stepped pin 210 is housed. A first oil passage 411 is communicated with one of ends of the first diameter part 211. The first oil passage 411 is communicated with a discharge pipe of the first pump 131. A second oil passage 412 is communicated with one of ends of the second diameter part 212. The second oil passage 412 is communicated with a discharge pipe of the second pump 132. A ratio of a pressure receiving area of the first diameter part 211 and a pressure receiving area of the second diameter part 212 is proportional to a ratio of a discharge capacity of the first pump 131 and a discharge capacity of the second pump 132.

According to the configuration, the left stepped pin 210 is biased toward the swash plate 240 corresponding to the discharge amount of the first pump 131 or the discharge amount of the second pump 132. Namely, a tilt angle of the swash plate 240 is changed with the left stepped pin 210.

The right stepped pin 220 corresponds to the third damper mechanism 163 and the rotation deviation damper mechanism 165 in FIG. 11. The right stepped pin 220 has a third diameter part (small diameter part) 223 and a fourth diameter part (large diameter part) 224. The third diameter part 223 is formed at one of ends of the right stepped pin 220. The fourth diameter part 224 is formed at the other end of the right stepped pin 220, and the other end contacts with the swash plate 240. The fourth diameter part 224 has larger diameter than the third diameter part 223.

In the casing 300, spaces in which the right stepped pin 220 is housed are formed. In a third space 323, the third diameter part 223 of the right stepped pin 220 is housed. In a fourth space 324, the fourth diameter part 224 of the right stepped pin 220 is housed. A third oil passage 423 is communicated with one of ends of the third diameter part 223. The third oil passage 423 is communicated with a discharge pipe of the third pump 133. A fourth oil passage 424 is communicated with one of ends of the fourth diameter part 224. The fourth oil passage 424 is communicated with a pilot pipe of the electromagnetic proportional control valve 169.

According to the configuration, the right stepped pin 220 is biased toward the swash plate 240 corresponding to the discharge amount of the third pump 133 or the pilot pressure controlled with the electromagnetic proportional control valve 169. Namely, the tilt angle of the swash plate 240 is changed with the right stepped pin 220.

INDUSTRIAL APPLICABILITY

The present invention can be used for a working vehicle.

The invention claimed is:

1. A working vehicle having a fixed displacement type hydraulic pump driven by power from an engine and a working hydraulic actuator driven by hydraulic oil sent from the fixed displacement type hydraulic pump, comprising:

an electromagnetic relief valve changing a pressure of the hydraulic oil from the fixed displacement type hydraulic pump;

a controller controlling the electromagnetic relief valve; a sensor detecting an actual rotation speed of the engine;

a variable displacement type hydraulic pump driven by the power from the engine and driving the working hydraulic actuator by sending hydraulic oil;

a hydraulic cylinder changing a swash plate angle of the variable displacement type hydraulic pump; and an air conditioning device driven by the power from the engine, wherein the electromagnetic relief valve is operated following each on and each off operation of a compressor of the air conditioning device so as to change the pressure of the hydraulic oil from the fixed displacement type hydraulic pump wherein the controller controls the hydraulic cylinder so that:

when the load of the engine is increased and the actual rotational speed of the engine becomes lower than the set rotation speed, the hydraulic cylinder is operated corresponding to the deviation between the actual rotational speed of the engine and the set rotation speed so as to change the swash plate angle of the variable displacement type hydraulic pump, and when the swash plate angle becomes a limiting angle, the electromagnetic relief valve is operated corresponding to the deviation so as to change the pressure of the hydraulic oil from the fixed displacement type hydraulic pump.

2. A working vehicle having a fixed displacement type hydraulic pump driven by power from an engine and a working hydraulic actuator driven by hydraulic oil sent from the fixed displacement type hydraulic pump, comprising:

an electromagnetic relief valve changing a pressure of the hydraulic oil from the fixed displacement type hydraulic pump;

a controller controlling the electromagnetic relief valve; a sensor detecting an actual rotation speed of the engine;

a variable displacement type hydraulic pump driven by the power from the engine and driving the working hydraulic actuator by sending hydraulic oil;

a hydraulic cylinder changing a swash plate angle of the variable displacement type hydraulic pump; and an air conditioning device driven by the power from the engine; and a clutch cutting off and connecting power transmission from the engine to the air conditioning device, wherein wherein the controller controls the hydraulic cylinder so that:

when the load of the engine is increased and the actual rotational speed of the engine becomes lower than the set rotation speed, the hydraulic cylinder is operated corresponding to the deviation between the actual rotational speed of the engine and the set rotation speed so as to change the swash plate angle of the variable displacement type hydraulic pump, and when the swash plate angle becomes a limiting angle, the electromagnetic relief valve is operated corresponding to the deviation so as to change the pressure of the hydraulic oil from the fixed displacement type hydraulic pump; and the controller controls the clutch cutting off and connection of the clutch so that when the load of the engine is increased and the actual rotational speed of the engine becomes lower than the set rotation speed, the pressure of the hydraulic oil from the fixed displacement type hydraulic pump is changed with the electromagnetic relief valve corresponding to the deviation between the actual rotational speed of the engine and the set rotation speed, and when the actual rotational speed of the engine becomes lower than the set rotation speed though the pressure of the hydraulic oil from the fixed displacement type hydraulic pump is changed, the clutch is disengaged.

* * * * *